US006039314A

United States Patent [19]

Miller et al.

[11] Patent Number: 6,039,314

[45] Date of Patent: Mar. 21, 2000

[54] SELF-FILLING STORAGE DEVICE FOR CARD-SHAPED DATA CARRIERS

[75] Inventors: Gert Miller; Peter Höffges, both of Mönchengladbach, Germany

[73] Assignee: Scheidt & Bachmann GmbH, Germany

[21] Appl. No.: 08/874,557

[22] Filed: Jun. 13, 1997

[30] Foreign Application Priority Data

Jun. 29, 1996 [EP] European Pat. Off. ..... 96110551

[51] Int. Cl.[7] ..... B65H 3/44

[52] U.S. Cl. ..... 271/9.01; 271/9.12; 271/9.13

[58] Field of Search ..... 271/3.08, 10.11, 271/10.09, 126, 9.01, 9.12, 9.13

[56] References Cited

U.S. PATENT DOCUMENTS 4,966,357 10/1990 Burger ..... 271/9.12
5,624,108 4/1997 Kubo ..... 271/9.12

FOREIGN PATENT DOCUMENTS 0175175 3/1986 European Pat. Off. .
0542226 5/1993 European Pat. Off. .
9403433 8/1994 Germany .

*Primary Examiner*—David H. Bollinger
*Attorney, Agent, or Firm*—Robert W. Becker & Associates

[57] ABSTRACT

A self-filling storage device for memory cards has at least one storage container having a storage compartment. The storage compartment has a common opening for receiving and releasing memory cards. A cover plate for covering the common opening is provided. The cover plates has a first face facing the storage compartment and a second face facing away from the storage compartment. The cover plate is further provided with a cutout. At least one separating roller is positioned in the storage container at the second face and has a first position in which the separating roller projects through the cutout into the storage compartment against a return force. The separating roller acts on a memory card positioned in the storage compartment at the first face or acts on a memory card positioned at the second face for insertion into the storage compartment. At least one transport roller is positioned in the storage container at the second face and cooperates with the second face for transporting a memory card across the cover plate.

12 Claims, 8 Drawing Sheets

SELF-FILLING STORAGE DEVICE FOR CARD-SHAPED DATA CARRIERS

BACKGROUND OF THE INVENTION

The present invention relates to self-filling storage devices for card-shaped data carriers (memory cards) with at least one storage container and at least one roller for dispensing or receiving such memory cards.

Such storage devices for card-shaped data carriers (memory cards) are, for example, known in different embodiments for receiving and dispensing user authorization cards for parking structures. These known storage devices provide a reliable dispensing action, respectively, reliable intake of data carriers into the storage container with respective dispensing, respectively, intake rollers; however, in practice it was found that for the arrangement of a plurality of such storage containers in one storage device these storage containers are non-uniformly emptied and/or filled so that it may occur that the storage container nearest to the dispensing slot is already empty even though in the other storage containers there are still memory cards present and the storage device due to the empty storage container at the dispensing slot, will not dispense any further data carriers. Also, it may happen with the known storage devices that, due to the storage container at the dispensing slot being filled, the intake of further data carriers is prevented even though the rearwardly arranged storage containers are not yet filled or not yet entirely filled.

It is therefore an object of the present invention to provide a self-filling storage device with which the aforementioned disadvantages can be avoided and which allows for an automated filling and/or emptying of all storage containers.

SUMMARY OF THE INVENTION

A self-filling storage device for memory cards according to the present invention is primarily characterized by:

at least one storage container having a storage compartment;

the storage compartment having a common opening for receiving and releasing memory cards;

a cover plate for covering the common opening;

the cover plate having a first face facing the storage compartment and a second face facing away from the storage compartment;

the cover plate having a cutout;

at least one separating roller positioned in the storage container at the second face and having a first position in which the separating roller projects through the cutout into the storage compartment against a return force;

the separating roller acting on a memory card positioned in the storage compartment at the first face or acting on a memory card positioned at the second face for insertion into the storage compartment;

at least one transport roller positioned in the storage container at the second face and cooperating with the second face for transporting a memory card across the cover plate.

The separating roller is moved from the first position into a second position outside of the storage compartment by a memory card passing across the cover plate.

Preferably, the at least one storage container further comprises a pivot member, wherein the separating roller is connected to the pivot member and wherein the return force acts on the pivot member.

The pivot member is pivotable about an axis of rotation of the transport roller.

The storage container may further comprise a spring and the spring may provide the return force acting on the separating roller.

The transport roller is preferably adjustable in a direction perpendicular to the cover plate in order to accommodate memory cards of different thickness.

Advantageously, the storage container further comprises a drive belt for connecting the transport roller and the separating roller.

The separating roller has a cam in the shape of a circular ring segment.

The storage container may further comprise a bottom plate positioned in the storage compartment and biased in the direction toward the cover plate. Memory cards stored in the storage compartment are positioned between the bottom plate and the cover plate.

The storage container may further comprise a locking element for locking the cover plate to prevent insertion of memory cards into the storage compartment, wherein the locking element is controlled by the bottom plate.

The storage container may further comprise a control slide and a spring-loaded pivot lever, wherein the control slide is connected to the bottom plate and acts on the pivot lever in the first and second end position of the bottom plate for controlling the locking element.

The control slide comprises a slot and the bottom plate comprises a pin engaging the slot.

The control slide and/or the pivot lever have abutments. The pivot lever may comprise a spring wire for spring-loading the pivot lever.

According to the present invention, the storage container has a cover plate for the common receiving and dispensing opening which cover plate comprises a cutout for the separating roller. The separating roller can be inserted into the storage compartment against a return force. The separating roller acts either on a memory card adjacent to the cover plate within the storage compartment or on a memory card positioned on the cover plate which is to be introduced in the storage compartment. A transport roller is provided that cooperates with the second outer side of the cover plate (the face facing away from the storage compartment) for transporting a memory card passing through the storage container.

The advantage of the inventive design is that for dispensing or receiving of memory cards all storage compartments can be completely emptied, respectively, filled. For a plurality of storage containers arranged sequentially one after another, the dispensing action begins with the storage container farthest away from the dispensing slot and ends after it has been emptied and the storage containers arranged between it and the dispensing slot have been emptied. The filling of the storage containers when receiving the card-shaped data carriers (memory cards) is performed in the reverse sequence, i.e., beginning with the forward storage container adjacent to the intake slot (dispensing slot).

According to a preferred embodiment of the invention, the separating roller can be moved from its first position out of the storage compartment by a memory card passing through the storage container. In this manner, it is ensured that only those memory cards contained in the storage containers to the rear will be transported to the dispensing slot. The memory card guided along the cover plate lifts the separating rollers from the cutout of the cover plate and thus disengages them from the uppermost memory card positioned within the storage compartment.

In order to provide the separating roller with a sufficient pressure acting onto the memory card passing through the storage container and to ensure that the separating roller, after passing of the memory card, will pivot back into the cutout of the cover plate, the separating roller is supported pivotably at a pivot member that is loaded by a return force. According to a preferred embodiment of the invention, this pivot member is pivotable about the axis of rotation of the transport roller whereby the return force is provided by a spring.

The adaptation of the transport roller to various card thickness can be achieved in that the transport roller is displaceable perpendicularly to the cover plate.

According to a further embodiment of the invention, the separating roller and the transport roller are connected to one another by a drive belt via which the rotation of the transport roller is also transmitted onto the separating roller. Advantageously, the separating roller is embodied as a cam shaft with a cam in the shape of a circular ring segment so that for one rotation of the separating roller the memory card positioned thereat is moved only by a portion of the circumferential length, i.e., by the length of the circular ring segment.

Finally, it is suggested with the present invention that the memory cards are supported by a bottom plate which is force-loaded in the direction toward the cover plate. This ensures that the card-shaped data carriers arranged within the storage compartment are at all times engaged by the separating roller penetrating through the cutout of the cover plate for transport toward the dispensing slot.

In order to ensure that during filling of the storage containers with data carriers, the storage compartment adjacent to the dispensing or intake slot is filled first with data carriers before the subsequently arranged storage containers will receive data carriers, it is suggested according to another embodiment of the invention that the outwardly facing side of the cover plates of the individual storage containers (the side facing the dispensing or intake slot) can be locked by a locking element in order to prevent introduction of memory cards. The locking element is controlled as a function of the position of the bottom plate of the individual storage compartments. Each locking element is activated by a spring-loaded pivot lever that is activated by a control slide only in the end positions of the respective bottom plate.

The connection between the control slide and the bottom plate can inventively be achieved with a pin-and-slot control.

According to another embodiment of the invention the release of the pivot lever via the control slide is achieved by abutments connected to the pivot lever itself or to the control slide. With these abutments and the connection between the control slide and the bottom plate it is ensured in a simple manner that the pivot lever will be activated only in the end positions of the bottom plate.

Inventively, it is suggested that the spring loading action for the pivot lever is provided by a spring wire.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1A:
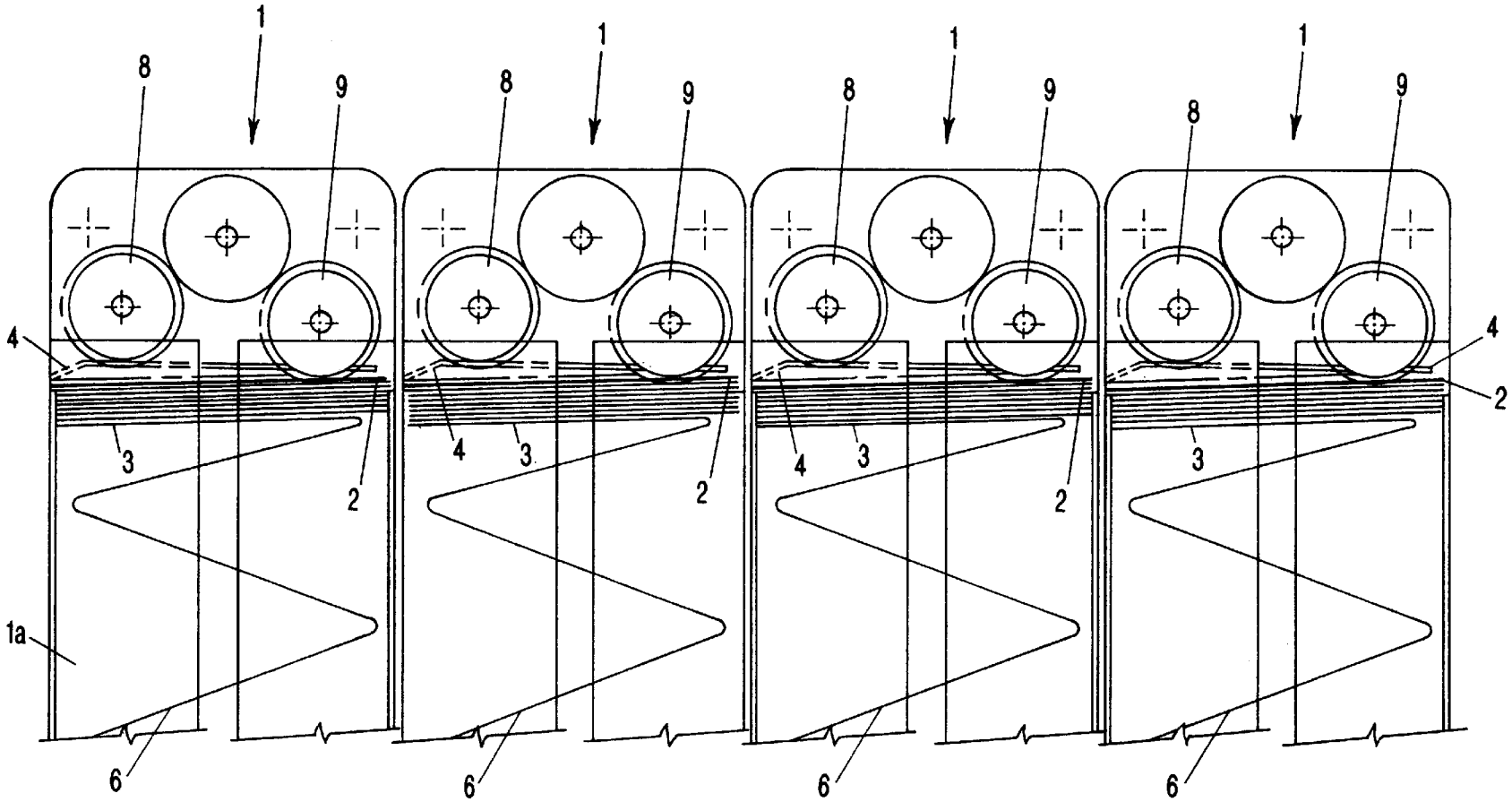
FIGS. 1*a*–1*d* show longitudinal sections of a storage device comprised of four storage containers in sequential phases of dispensing memory cards.
Figure 1B:
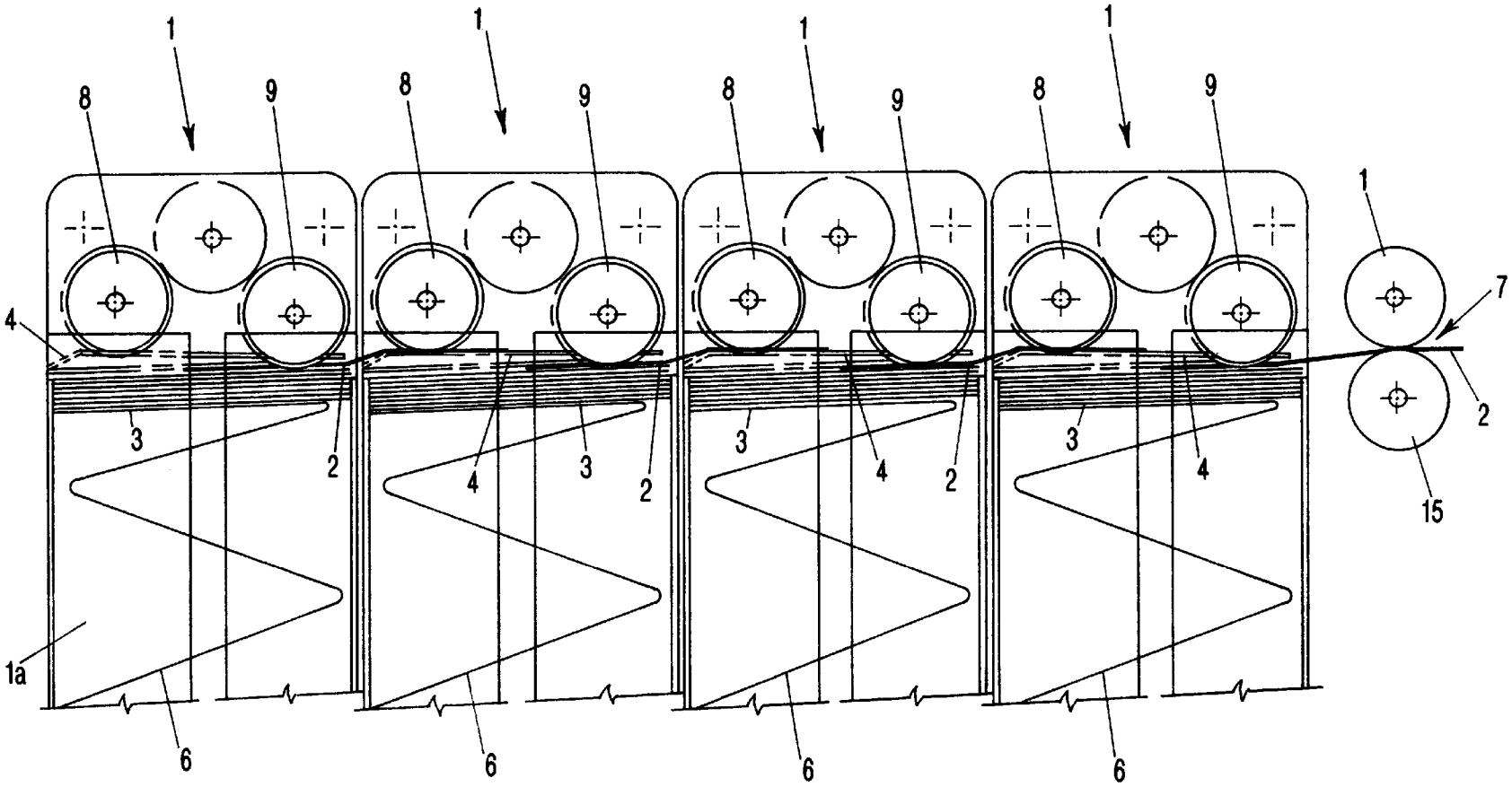

The present invention will now described in detail with the aid of several specific embodiments utilizing FIGS. 1 through 7.

The storage device represented in FIGS. 1*a* to 1*d* is comprised of four sequentially arranged storage containers 1 in which a plurality of card-shaped data carriers (memory cards) 2 are arranged on a bottom plate 3. The actual storage volume or compartment 1*a* of each storage container 1 is provided at the common opening for receiving and releasing memory cards with a cover plate 4 that has an insertion slot 5 for receiving, respectively, releasing the memory cards 2. The bottom plate 3 which supports the memory cards 2 is force-loaded in the direction toward the cover plate 4. For this purpose, in the represented arrangement of the storage containers 1, a spring 6 is arranged below the bottom plates 3 so that the uppermost memory card 2 of each storage container 1 abuts directly at the underside (first face) of the cover plate 4.

Figure 2:
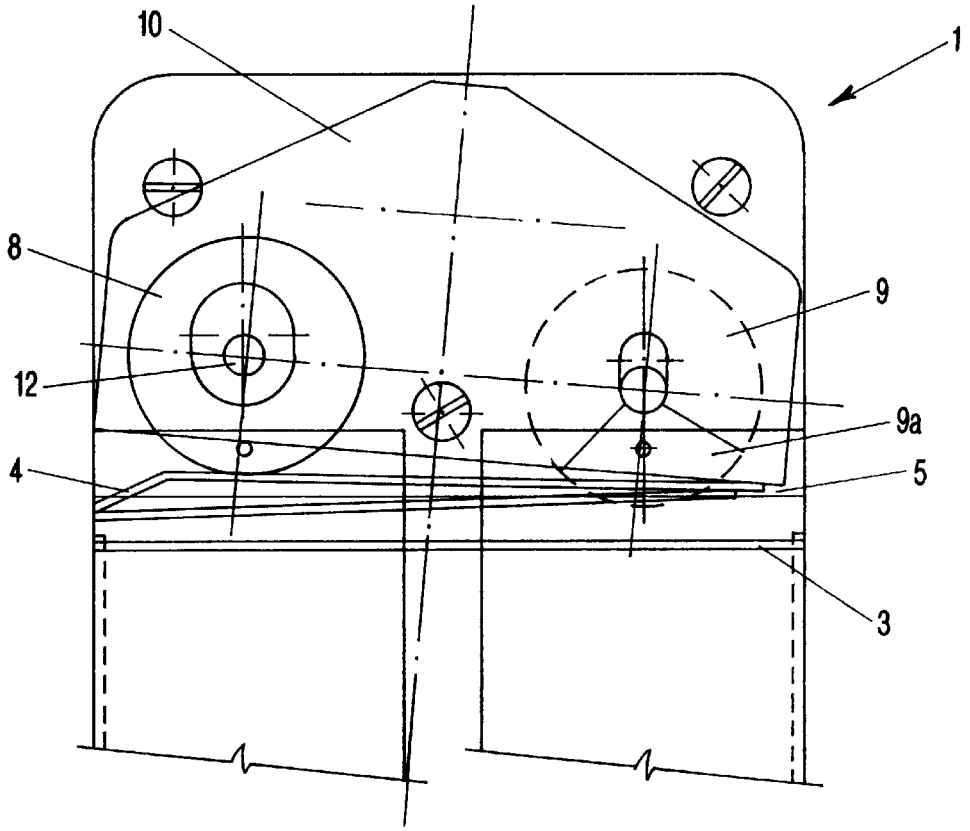
FIG. 2 is a schematic side view of the upper portion of the storage container which effects the dispensing, respectively, intake of memory cards.

For transporting a memory card from the storage containers 1 to the dispensing and intake slot 7 of the storage device, a transport roller 8 and a separating roller 9 are arranged above the cover plate 4 of each storage container 1. The construction of this upper portion of each storage container 1 is shown in more detail in FIGS. 2 and 3. As can be seen in FIG. 2, the transport roller 8 and the separating roller 9 are rotatably supported on a common pivot member 10.

Figure 4:
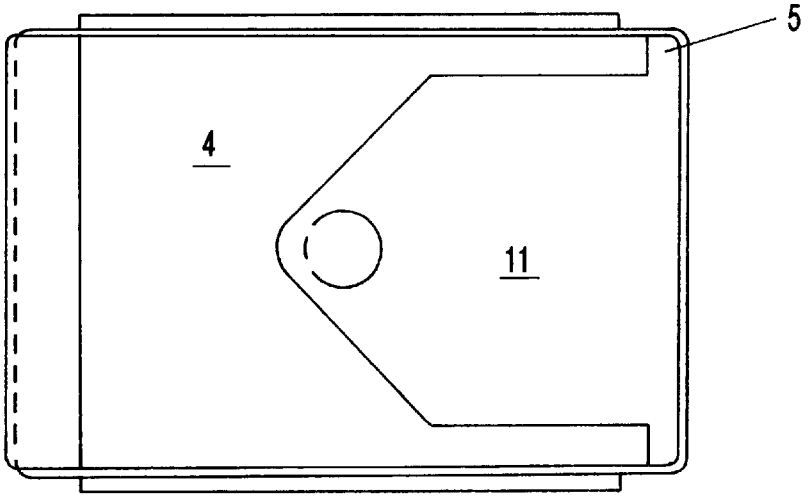
FIG. 4 shows a plan view of a cover plate.
Figure 5:
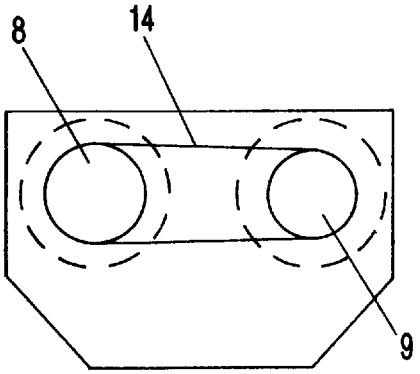
FIG. 5 is a schematic side view of the gear between the transport and separating rollers.
Figure 6:
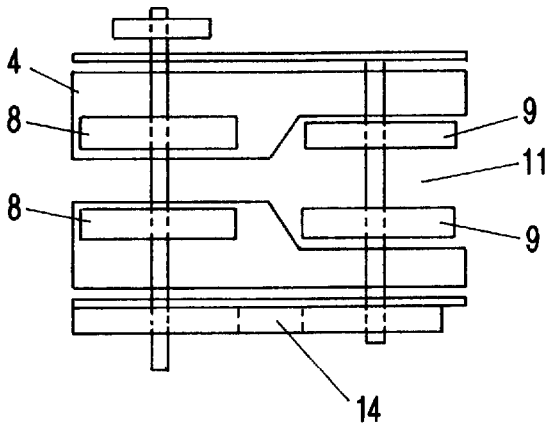
FIG. 6 is a schematic plan view of the representation according to FIG. 5.

The plan view shown in FIG. 4 of the cover plate 4 shows that the cover plate 4 in the area of the separating roller 9 is provided with a cutout 11 through which a direct access into the storage compartment 1*a* of the storage container 1, respectively, the memory cards 2 arranged therein is possible. In the transporting direction the cutout 11 of the cover plate 4 has a transition into the receiving and releasing slot 5.

Figure 3:
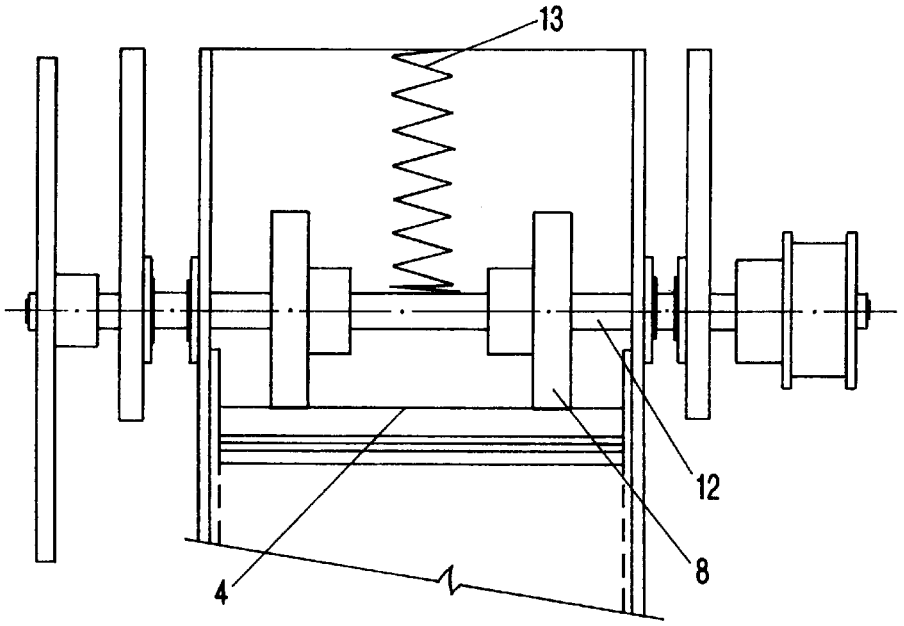
FIG. 3 shows a section along the line III—III of FIG. 2.

As can be seen in FIG. 2, the transport roller 8 and the separating roller 9 are supported by the pivot member 10 which is pivotable about the axis 12 of the transport roller 8. Due to this pivotable support of the pivot member 10 about the axis 12 of the transport roller 8, the separating roller 9 can be moved in and out of the cutout 11 of the cover plate 4. In this manner, it is possible to engage with the separating roller 9 the uppermost memory card 2 positioned within the storage compartment 1*a* and to move the memory card 2 via the releasing and receiving slot 5 out of the storage compartment 1*a*. In order to provide the separating roller 9 with the necessary pressure to be applied onto the memory card 2 for transport along the upper side (second face) of the cover plate 4 in the direction toward the dispensing and intake slot 7, respectively, onto a memory card 2 to be released from the storage compartment 1*a*, the separating roller 9 supported on the pivot member 10 is force-loaded by a spring 13 that is supported with one end at the housing of the storage container 1, as shown in FIG. 3.

The transport roller 8 is driven by a non-represented drive provided at the backside of each one of the storage containers 1. The transport roller 8 and the separating roller 9 are connected to one another at the front side of each one of the storage containers 1 by a drive belt 14 which transmits the rotation of the driven transport roller 8 onto the separating roller 9. As can be seen further from FIG. 2, the separating roller 9 has a cam 9*a* in the shape of a circular ring segment. With this cam 9*a* the separating roller 9 acts only with a certain circumferential portion as a transport roller.

The transport of memory cards 2 to the dispensing and intake slot 7 (represented in FIGS. 1*a* through 1*d*) is a follows.

FIG. 1*a* shows a storage device comprised of four storage containers 1 in which each one of the storage containers 1 has card-shaped data carriers (memory cards) 2 arranged between the bottom plate 3 and the cover plate 4.

The uppermost memory card 2 of each storage container 1 is represented in the drawing with a solid black line. The memory cards 2 are forced by a spring 6 acting on the bottom plate 3 against the underside (first face) of the cover plate 4. As can be seen further from FIG. 1*a*, at the beginning of dispensing of memory cards 2 all separating rollers 9 engage through the cutout 11 of the cover plates 4 the interior of the storage compartments 1*a* and act on the uppermost memory card 2. As soon as the separating rollers 9 are moved via the transport rollers 8 and the intermediately positioned gear 14, the uppermost memory card 2 is transported via the releasing and receiving slots 5 from the storage compartments 1*a* to the surface of the cover plate 4 where downstream thereof it is engaged by the transfer roller 8, as shown in FIG. 1*a*. The memory card 2 released by the forward storage container 1 is moved via the two dispensing and intake rollers 15 to the dispensing and intake slot 7.

Figure 1C:
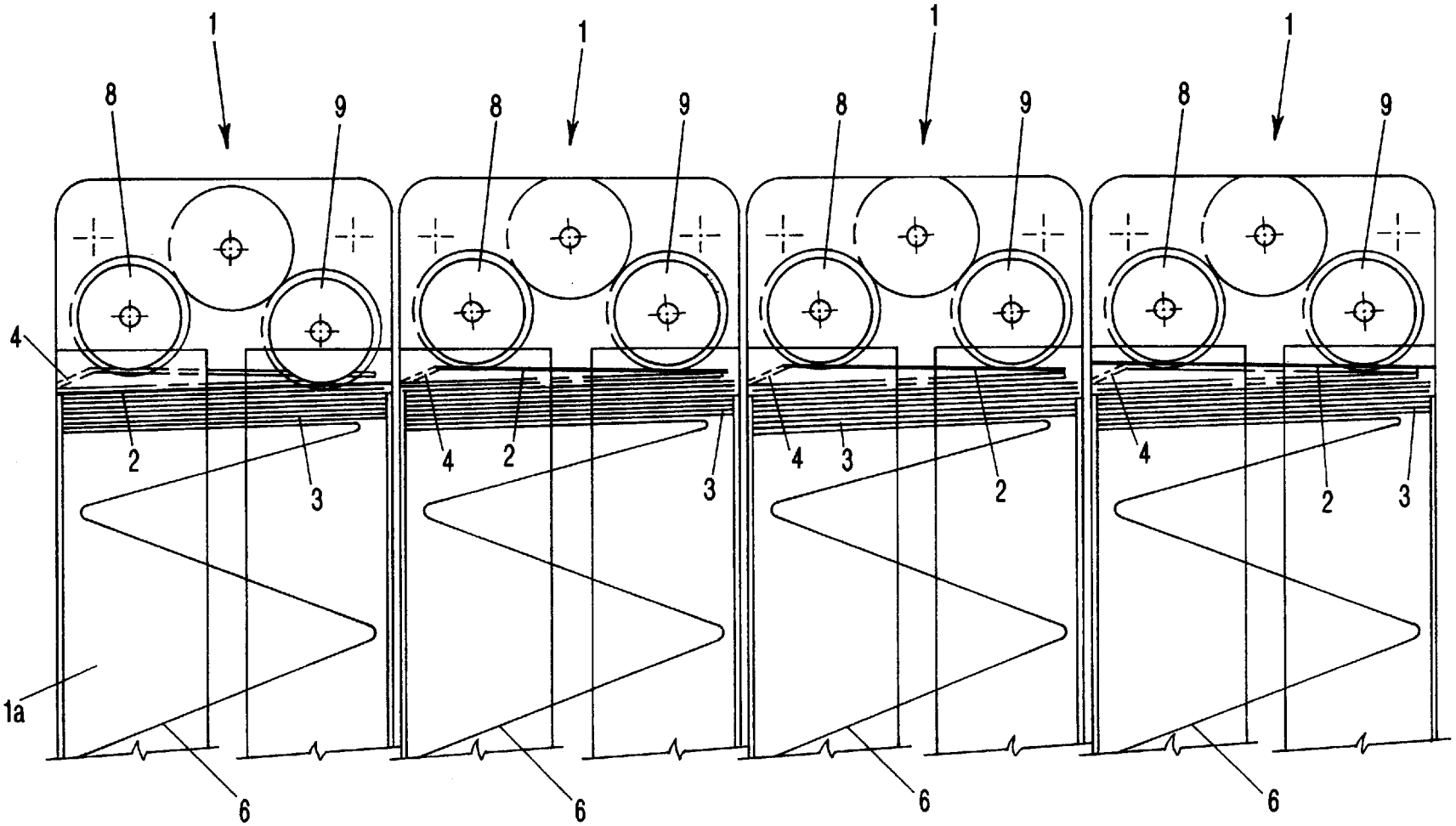
Figure 1D:
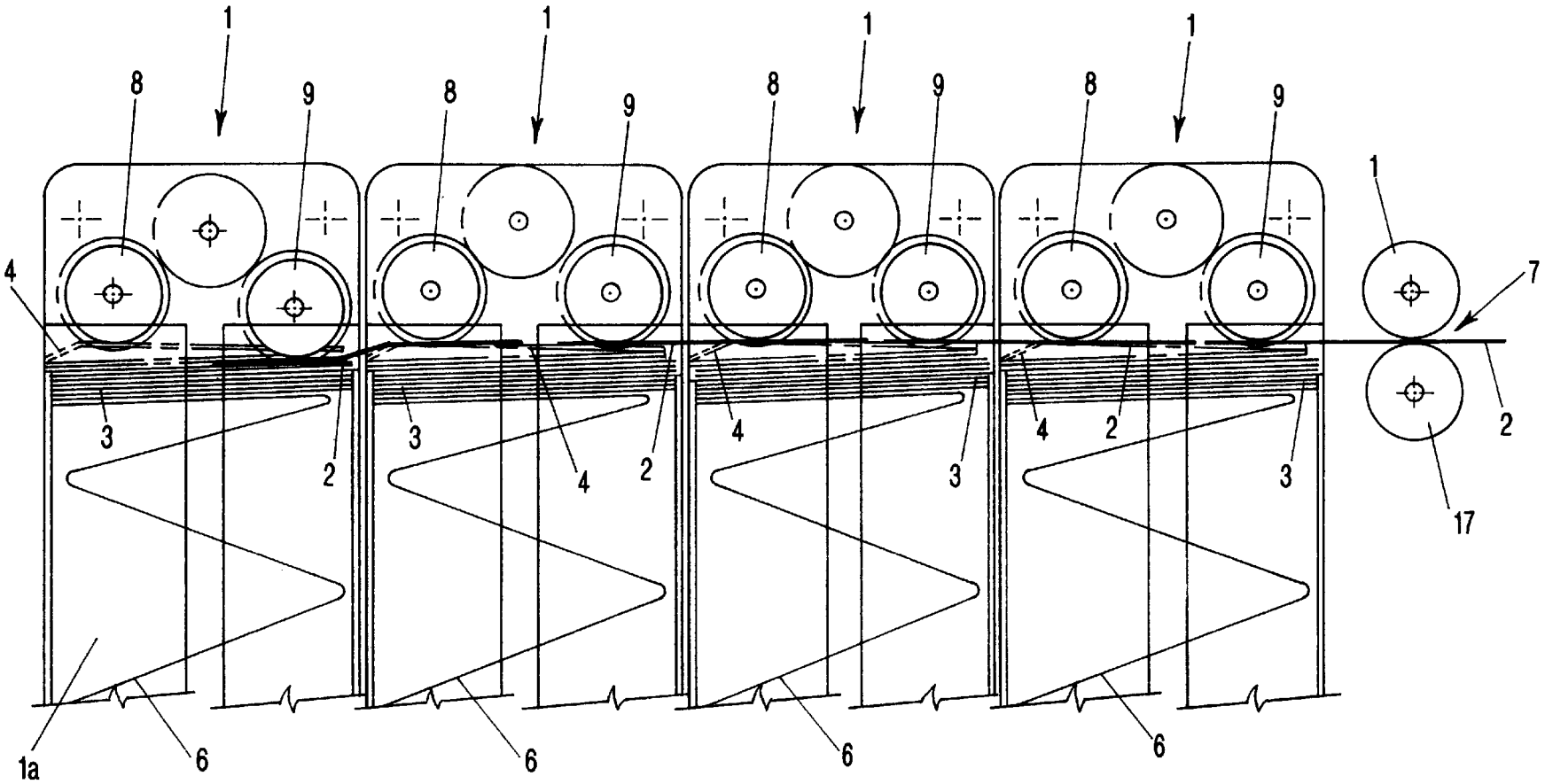

As can be seen in FIG. 1*c*, during transport of the memory card 2 along the surface of the cover plate 4 the separating rollers 9 are forced by the memory cards 2 passing through the storage containers out of the cutouts 11 of the cover plate 4 and thus take over the function of an additional transport roller. In another working step, as represented in FIG. 1*d*, the uppermost data carrier 2 of the rearmost container 1 is now moved by the separating roller 9 acting through the cutout 11 in the cover plate 4 via the releasing and receiving slot 5 out of the rearmost container 1. This memory card then reaches the surface of the cover plate 4 of the adjacently positioned storage container 1 and is engaged by the transport roller 8. As can be seen in this representation, the memory card 2 is transported along the surface of the cover plates 4 by the transport roller 8 and the separating roller 9 of each container 1. The separating rollers 9 are moved out of the cutouts 11 of the cover plates 4 by the memory card 2.

After the initiation of the dispensing process further memory cards 2 are moved out of the storage device from the storage container 1 which is farthest away from the dispensing and intake slot 7. Only when the storage container 1 farthest to rear is completely empty, is it possible to move the separating roller 9 of the second to last storage container 1 downwardly through the cutout 11 so that the separating roller 9 can again act on the uppermost memory card 2 of this second to last storage container 1 and can transport it via the receiving and releasing slot 5 from the compartment 1*a*.

As can be seen from FIGS. 1*a* through 1*d*, the release of the memory card 2 from the storage container 1 thus takes place in the sequence last storage container 1, second to last storage container 1, until the forward storage container 1, i.e., the one adjacent to the dispensing and intake slot 7 is empty. The intake of memory cards 2 via the intake and dispensing slot 7 into the storage containers 1 takes place in the reverse sequence, i.e., first the storage container 1 adjacent to the dispensing and intake slot 7 is filled with memory cards before the sequentially arranged storage containers 1 will receive memory cards 2.

In order to ensure that upon intake of memory cards 2 via the dispensing and intake slot 7 first the storage container 1 adjacent to the slot 7 is filled with memory cards 2, and not the neighboring container 1, the outwardly facing side of the closure plate 4 of the rearwardly arranged storage containers 1 facing the slot 7 is lockable with a locking element 16 which is controlled as function of the position of the bottom plate 3 of each storage container 1. In FIGS. 7*a* through 7*e*, for example, the function of the locking element 16 as a function of the position of the bottom plate 3 is represented in a time sequence with the aid of one storage container 1.

Figure 7C:
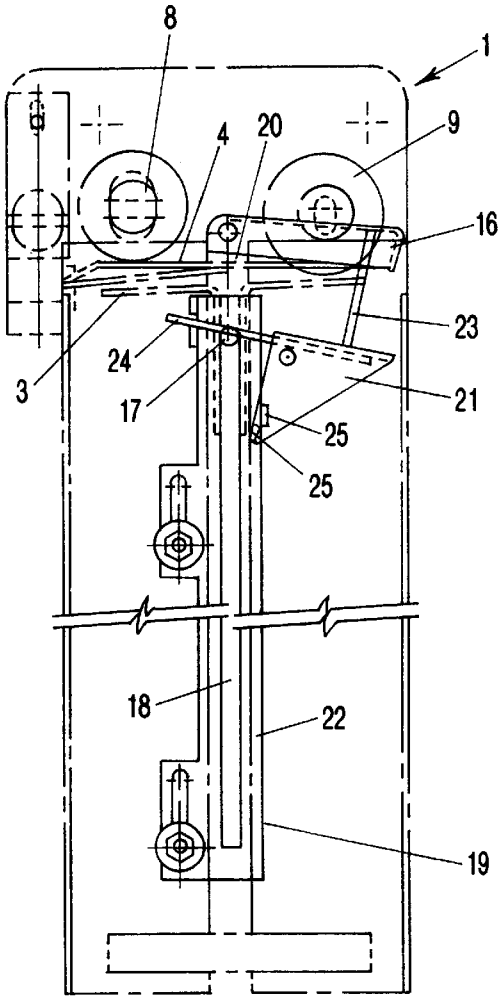
FIGS. 7*a*–7*e* show longitudinal sections of the storage container during sequential faces of releasing and receiving memory cards.
Figure 7B:
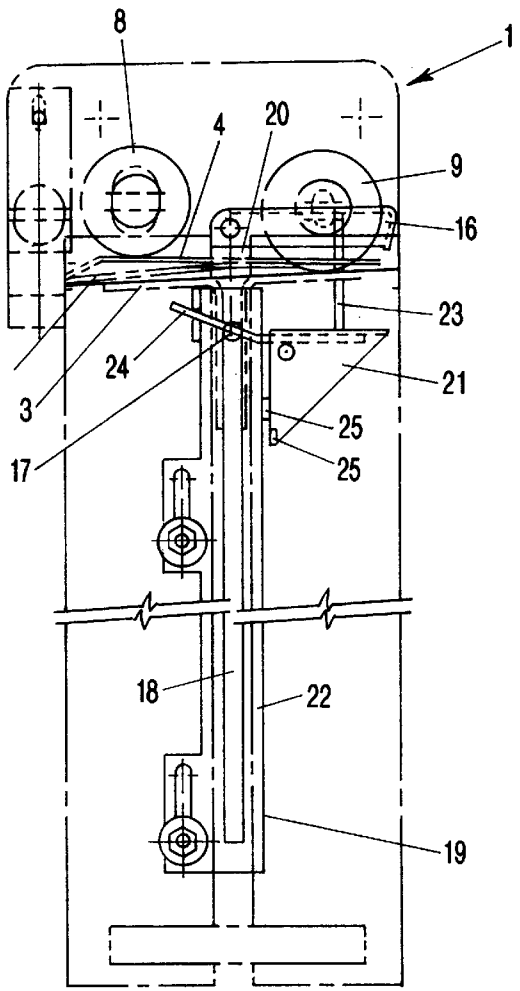
Figure 7A:
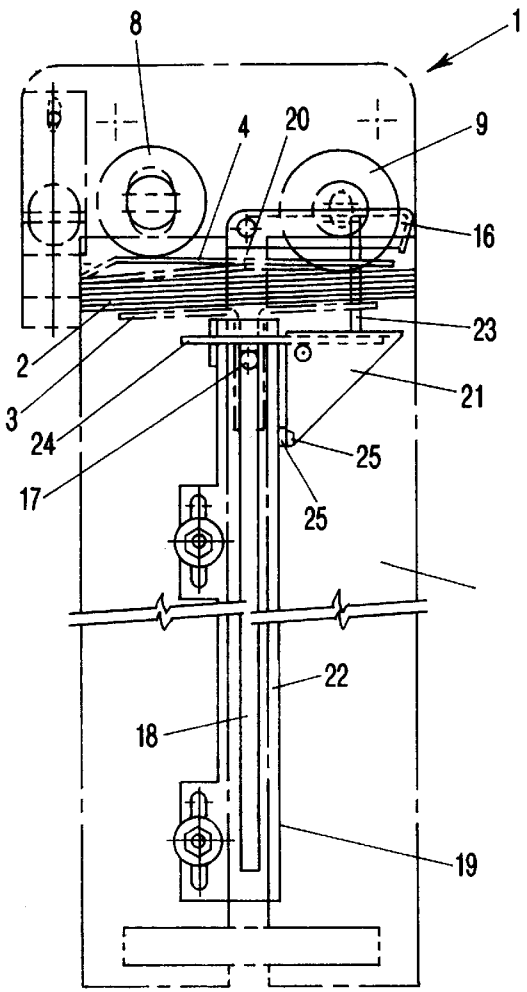
Figure 7E:
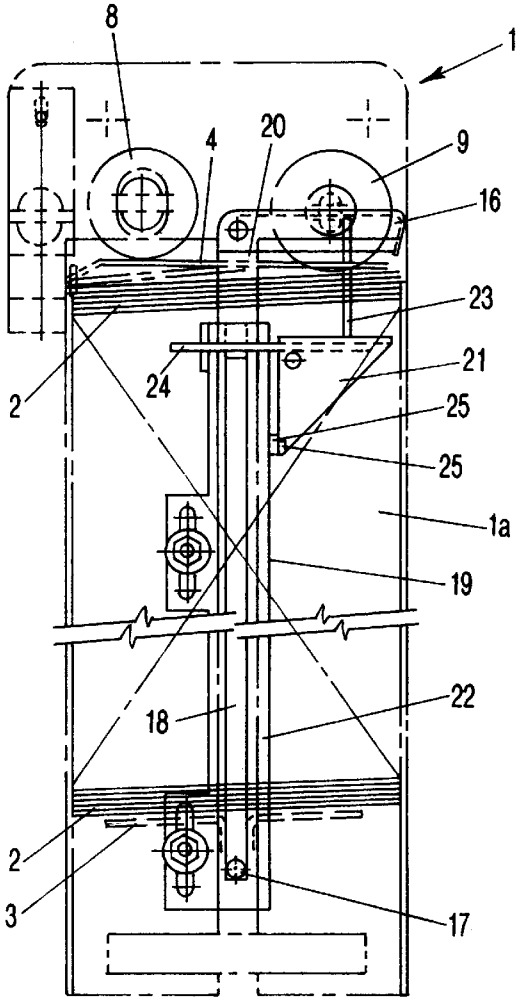
Figure 7D:
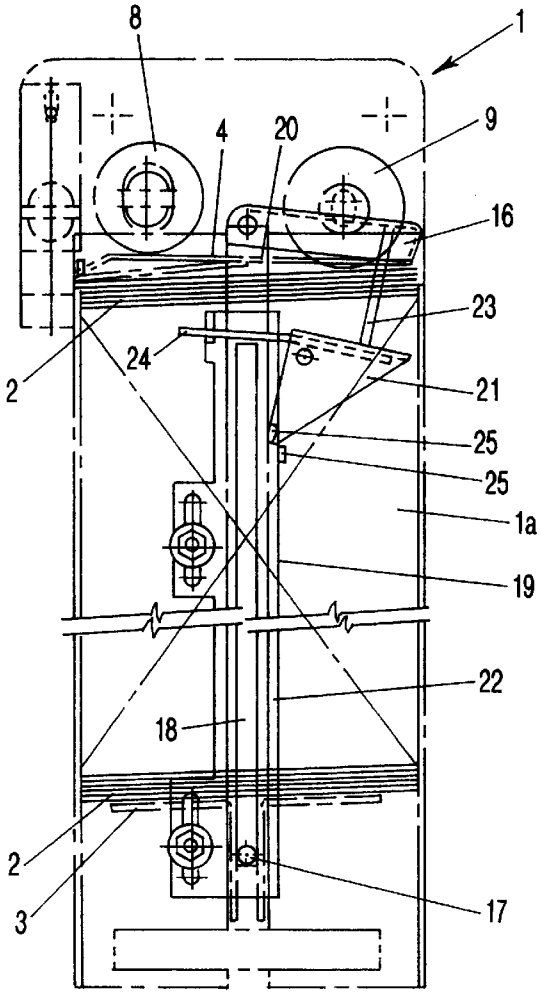

As can be seen in FIGS. 7*a* through 7*e*, each bottom plate 3 has fixedly connected thereto the pin 17 which is guided in the longitudinal slot 18 of a guide 19 arranged at a longitudinal side of the storage container 1. The pin 17 upon removal of memory cards 2 from the storage compartment 1*a* is moved upwardly because it is fixedly connected to the bottom plate 3, compare FIG. 7*a*. At the upper end of the guide 19 a deflecting lever 20 is arranged which projects into the longitudinal slot 18 and which is engaged eventually by the pin 17 in the end position of the bottom plate 3. As can be seen in FIGS. 7*b* and 7*c* the deflecting lever 20 is moved upwardly in the longitudinal direction by the pin 17 so that the locking element 16 which is pivotably connected to the pivot lever 20 can be downwardly moved counter to the displacement direction of the deflecting lever 20. In one end position of the bottom plate 3, i.e., in the position in which all memory cards 2 have been removed from the storage compartment 1*a*, the locking element 16 is deflected by the deflecting lever 20, respectively, the pin 17 connected to the bottom 3 to such an extent that the locking element 16 locks the outwardly facing side of the cover plate 4 against transport of data carriers. By preventing transport of memory cards 2 across the cover plate 4 with the locking element 16 when the container 1 is completely empty, it is ensured that memory cards 2 inserted into the storage device cannot be transported into the rearwardly arranged storage container 1 but instead must be introduced into the storage container 1 at the forward end.

In order to ensure that for filled storage container 1 the locking element 16 allows further transport of memory cards 2 across the surface of the cover plate 4, the locking element 16 is connected to a spring-loaded pivot lever 21 which is actuated by a control slide 22 only in the end positions of the bottom plate 3.

As can be seen in FIGS. 7*a* through 7*e*, the locking element 16 and pivot lever 21 are connected by a pin 23 provided at the free end of the locking element 16 such that the pivot lever is downwardly deflected by the spring force 21 via the pin 23 and the locking element 16 which are deflected by the upwardly moving pin 17, respectively, the deflecting lever 20 counter to the direction of movement of the plate bottom 3. For producing the spring force acting on the pivot lever 21, the pivot lever 21 is supported on the spring wire 24 which is connected to the exterior side of the storage container 1.

As can be seen in FIGS. 7*b* and 7*c*, the control slide 22, which provides the guide 19 and which is displaceable in the longitudinal direction to a limited extent, is in the uppermost position when the storage container 1 is empty. In this position, shown in FIG. 7*c*, the locking element 16 and the pivot lever 21 are displaced by the greatest possible amount, i.e., are downwardly deflected. In this extreme position, abutments 25 provided at the pivot lever 21 and the exterior side of the control slide 22 are locked such that the pivot lever 21 and the locking element 16 remain in the deflected position in which the cover plate 4 is locked even when the bottom plate 3 and thus the pin 17 no longer abut the deflecting lever 20.

The release of the pivot lever 21 and thus of the locking element 16 takes place only when the pin 17 connected to the bottom plate 3 abuts the lower end of the longitudinal slot 18 of the control slide 22 and the entire guide 19 is displaced upon filling of the storage container 1 with more memory cards 2. When the container 1 is filled to a degree represented in FIGS. 7*d* and 7*e*, the downward displacement of the control slide 22 by the pin 17 separates the abutments 25 between pivot lever 21 and control slide 22 from one another. Due to the stressed spring wire 24, the pivot lever 21 is thus returned into its initial position and forces the pin 23 and thus the locking element 16 in the upward direction away from the cover plate 4 so that a memory card 2 introduced into the storage device can now be transported across the surface of the cover plate 4 to the storage container 1 to the rear of the device.

With the above disclosed control of the locking element 16 it is thus insured that only upon complete filling of the forward storage container 1 it is possible to fill the storage containers 1 to the rear with memory cards 2.

The present invention is, of course, in no way restricted to the specific disclosure of the specification and drawings, but also encompasses any modifications within the scope of the appended claims.

What we claim is:

1. A self-filling storage device for memory cards, said storage device comprising:

at least one storage container having a storage compartment;

said storage compartment having a common opening for receiving and releasing memory cards;

a cover plate for covering said common opening;

said cover plate having a first face facing said storage compartment and a second face facing away from said storage compartment;

said cover plate having a cutout;

a first spring mounted in said storage compartment;

at least one separating roller positioned in said storage container at said second face and having a first position in which said separating roller projects through said cutout into said storage compartment against a return force generated by said first spring;

said separating roller acting on a memory card positioned in said storage compartment at said first face or acting on a memory card positioned at said second face for insertion into said storage compartment;

at least one transport roller positioned in said storage container at said second face and cooperating with said second face for transporting a memory card across said cover plate.

2. A storage device according to claim 1, wherein said at least one storage container further comprises a pivot member, wherein said separating roller is connected to said pivot member and is pivoted from said first position into a second position outside of said storage compartment by a memory card passing across said cover plate, and wherein said first spring acts on said pivot member.

3. A storage device according to claim 2, wherein said pivot member is pivotable about an axis of rotation of said transport roller.

4. A storage device according to claim 1, wherein said transport roller is adjustable in a direction perpendicular to said cover plate in order to accommodate memory cards of different thickness.

5. A storage device according to claim 1, wherein said storage container further comprises a drive belt for connecting said transport roller and said separating roller.

6. A storage device according to claim 1, wherein said separating roller has a cam in the shape of a circular ring segment, wherein said separating roller acts only with said cam, acting as a transport roller, on the memory cards.

7. A storage device according to claim 1, wherein said storage container further comprises a bottom plate positioned in said storage compartment and a second spring biasing said bottom plate in a direction toward said cover plate, wherein memory cards stored in said storage compartment are positioned between said bottom plate and said cover plate.

8. A storage device according to claim 7, wherein said storage container further comprises a locking element for locking said cover plate to prevent insertion of memory cards into said storage compartment, wherein said storage container further comprises a control slide and a spring-loaded pivot lever, wherein said control slide is connected to said bottom plate and acts on said pivot lever in a first and second end position of said bottom plate for controlling said locking element.

9. A storage device according to claim 8, wherein said control slide comprises a slot and wherein said bottom plate comprises a pin engaging said slot.

10. A storage device according to claim 8, wherein said control slide has abutments for activating said pivot lever.

11. A storage device according to claim 8, wherein said pivot lever has abutments cooperating with said control slide for activating said pivot lever.

12. A storage device according to claim 8, wherein said pivot lever comprises a spring wire for spring-loading said pivot lever.

* * * * *